US008863955B2

(12) United States Patent
St-Onge

(10) Patent No.: US 8,863,955 B2
(45) Date of Patent: Oct. 21, 2014

(54) CONTAINER FOR FRANGIBLE ARTICLES SUCH AS EGGS

(75) Inventor: Yves St-Onge, Mascouche (CA)

(73) Assignee: Pactiv Canada Inc, Scarborough, Ontario (CA)

( * ) Notice: Subject to any disclaimer, the term of this patent is extended or adjusted under 35 U.S.C. 154(b) by 180 days.

(21) Appl. No.: 11/747,956

(22) Filed: May 14, 2007

(65) Prior Publication Data

US 2008/0283437 A1 Nov. 20, 2008

(51) Int. Cl.
*B65D 81/02* (2006.01)
*B65D 85/32* (2006.01)

(52) U.S. Cl.
CPC ..... *B65D 85/32* (2013.01)
USPC ..... 206/521.1; 206/521.8

(58) Field of Classification Search
USPC ..... 206/521–521.9; 3/521–521.9
See application file for complete search history.

(56) References Cited

U.S. PATENT DOCUMENTS

| | | | | | |
|---|---|---|---|---|---|
| 3,493,164 | A * | 2/1970 | Edwards | 206/521.1 |
| 3,771,712 | A * | 11/1973 | Richards | 206/521.1 |
| 3,813,027 | A * | 5/1974 | Misdom et al. | 206/521.1 |
| 4,057,188 | A * | 11/1977 | Steinhardt | 206/521.8 |
| 4,088,259 | A * | 5/1978 | Sutton | 206/521.1 |
| 4,090,658 | A * | 5/1978 | Fukuda | 206/521.1 |
| 4,205,777 | A * | 6/1980 | Brown et al. | 206/521.1 |
| 5,102,034 | A * | 4/1992 | Amabili | 206/521.1 |
| 5,503,858 | A * | 4/1996 | Reskow | 426/119 |
| 6,012,583 | A * | 1/2000 | Ramirez | 206/521.1 |
| 6,086,931 | A * | 7/2000 | Whiteford | 426/118 |
| 6,213,302 | B1 * | 4/2001 | Sanders et al. | 206/521.1 |
| 6,419,089 | B1 * | 7/2002 | Dall | 206/521.1 |
| 6,488,152 | B1 * | 12/2002 | Steffann | 206/521.1 |
| D520,377 | S * | 5/2006 | Beese et al. | D9/762 |
| 2005/0145529 | A1 * | 7/2005 | Andrews et al. | 206/521.1 |
| 2005/0178689 | A1 * | 8/2005 | Aardema et al. | 206/521 |
| 2005/0189256 | A1 * | 9/2005 | St-Onge | 206/521.1 |
| 2006/0060493 | A1 * | 3/2006 | Marshall | 206/521.1 |

FOREIGN PATENT DOCUMENTS

| | | |
|---|---|---|
| CA | 2028229 | 1/2003 |

* cited by examiner

*Primary Examiner* — Anthony Stashick
*Assistant Examiner* — Ernesto Grano
(74) *Attorney, Agent, or Firm* — Baker Botts LLP

(57) ABSTRACT

A container for frangible articles comprising a tray molded in a sheet of polymeric material having a hinge portion separating a bottom portion from a cover portion with the cover portion being pivotable into engagement with the bottom portion to conceal the frangible articles in the container. The bottom portion comprises rows of cavities with each cavity adapted to support a frangible article. The cavities have lugs projecting inwardly and from bottom to top from a main surface of the cavity to support the frangible article while maintaining air gaps between the frangible article and the main surface. Corner cavities are positioned at opposite leading corners of the bottom portion and each have a protective rib oriented toward its respective leading corner and projecting outwardly from the main surface and from bottom to top to provide structural integrity to the opposite leading corners of the container.

20 Claims, 4 Drawing Sheets

CONTAINER FOR FRANGIBLE ARTICLES SUCH AS EGGS

BACKGROUND OF THE INVENTION

1. Field of the Invention

The present invention relates to containers for frangible articles and, more particularly but not exclusively, to containers formed by vacuum-forming and used as egg boxes.

2. Background Art

It is known in the art to obtain trays by thermoforming techniques, especially vacuum-molding, and to stack them one into the other. It is also known to use such trays to define containers for frangible articles, such as egg box (see Applicant's Canadian Patent No. 2,028,229).

These manufacturing techniques produce cost-efficient containers that are often recyclable and stackable in opened positions so as to require little storage space. Moreover, the containers resulting from such manufacturing techniques are advantageously transparent/translucent, such that a consumer may view the frangible contents of the container without having to open the container. Whether the frangible articles be colored eggs from Auracana hens, hand-picked tomatoes or the like, the plastic sheet containers allow the product to be exposed, while providing some form of shielding against impacts and tampering.

As such containers are made of thin sheets of plastic, the geometry of these containers must be defined so as to provide suitable structural integrity to the container taking into account the manipulations the container goes through.

The containers accommodating these contents must often be stacked one on another in refrigerated cabinets of food markets. For instance, when such containers are used as egg boxes of large size, it appears that containers supporting the weight of other filled containers may not present a sufficient level of rigidity to prevent deformation. More specifically, containers have been known to collapse at their corners.

Moreover, as they are conveyed on automated production lines and equipment, these containers often sustain lateral pressure that may damage their corners. As damage to the frangible articles results in major inconveniences (e.g., loss of profitability, maintenance required to clean up, waste of products), it is desirable to improve the structural integrity of the containers for frangible articles.

SUMMARY OF INVENTION

It is therefore an aim of the present invention to provide a novel container for frangible articles that addresses issues associated with the prior art.

Therefore, in accordance with the present invention, there is provided a container for frangible articles comprising a tray molded in a sheet of polymeric material having a hinge portion separating a bottom portion from a cover portion with the cover portion being pivotable into engagement with the bottom portion to conceal the frangible articles in the container, the bottom portion comprising rows of cavities with each said cavity adapted to support a frangible article, each of the cavities having lugs projecting inwardly and from bottom to top from a main surface of the cavity to support the frangible article while maintaining air gaps between the frangible article and the main surface, with corner cavities from said cavities being positioned at opposite leading corners of the bottom portion and each having a protective rib oriented toward its respective leading corner and projecting outwardly from the main surface and from bottom to top to provide structural integrity to the opposite leading corners of the container.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
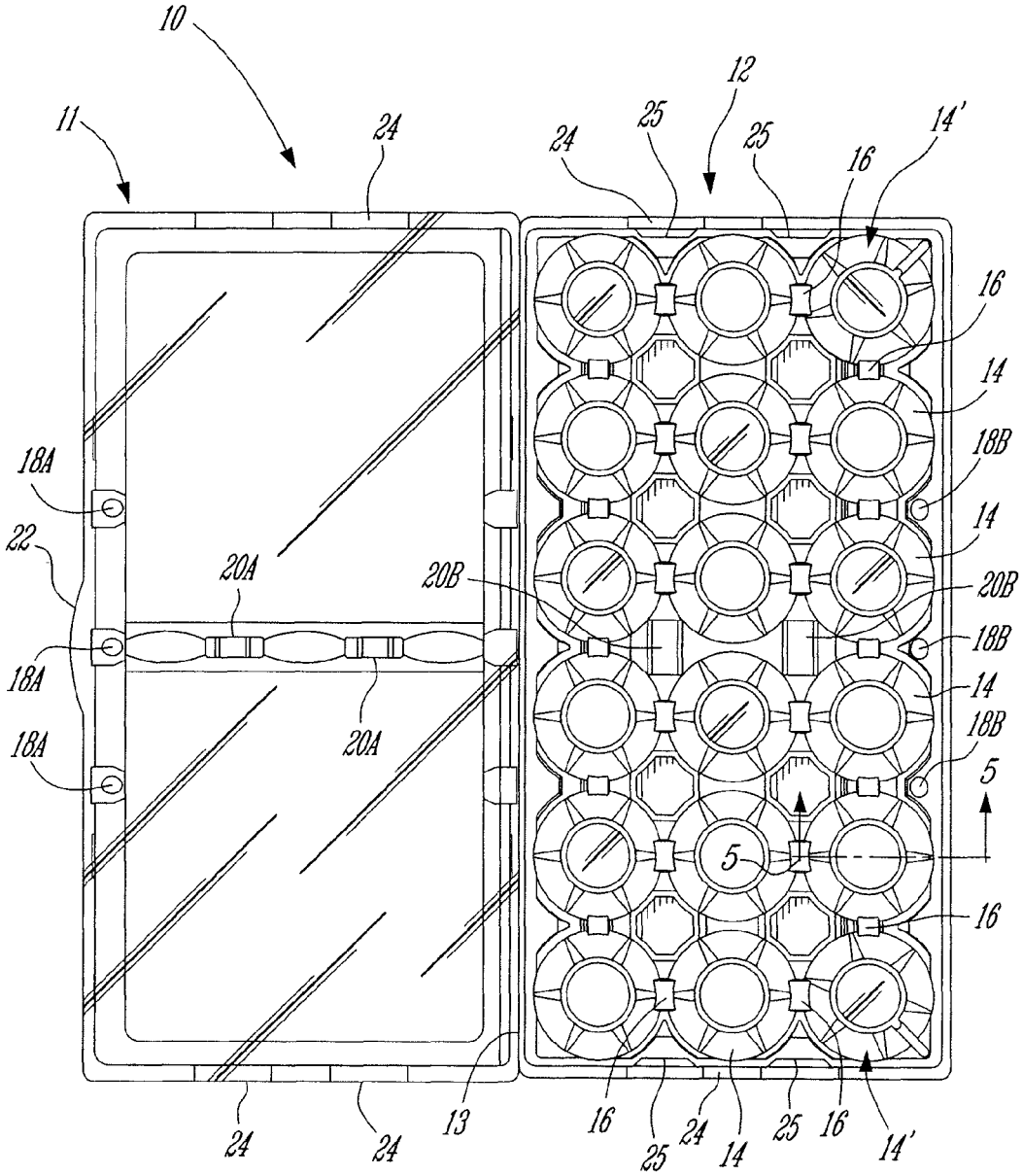
FIG. 1 is a top plan view of a container for frangible articles constructed in accordance with an embodiment of the present invention, and in an opened position.
Figure 2:
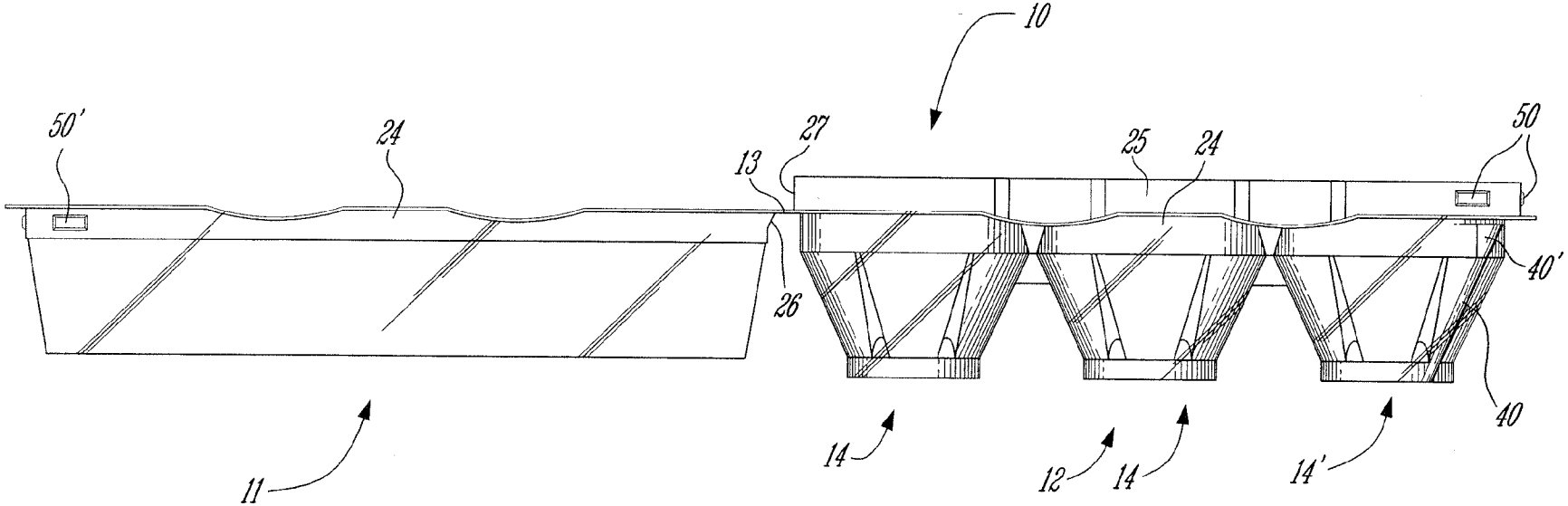
FIG. 2 is a side elevation view of the container of FIG. 1, in the opened position.
Figure 3:
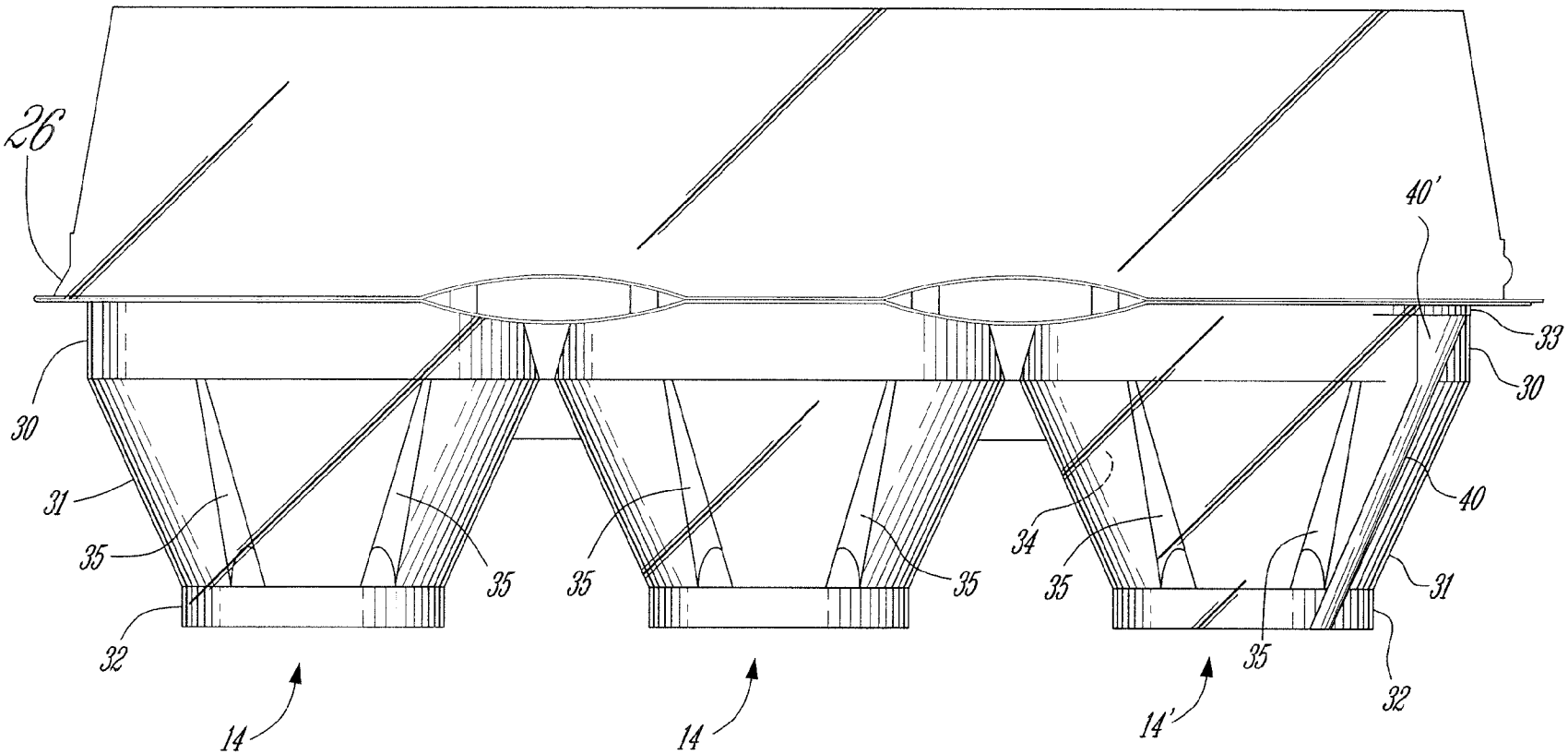
FIG. 3 is a side elevation view of the container of FIG. 1, in a closed position.

Referring now to the drawings, and more particularly to FIGS. 1 and 2, a container for frangible articles (e.g., eggs, foodstuff such as tomatoes, etc.) is found in the form of a tray 10, prior to being folded to create the container 10 (FIG. 3). The tray 10 is typically made of a transparent/translucent polymer. In an embodiment, the tray 10 is made of a sheet of polymeric material (e.g., thermoformable plastic) that is vacuum-molded into the shape illustrated in FIG. 1. One suitable thermoplastic material amongst others is polyethylene terephthalate.

The tray 10 has a cover portion 11 and a base portion 12. The cover portion 11 and the base portion 12 are separated by hinge portion 13, forming a longitudinal axis about which the cover portion 11 will be folded onto the base portion 12 so as to conceal the frangible articles in the container 10, as is shown in FIG. 3.

Referring to FIG. 1, rows of receiving cavities 14 are provided in the base portion 12. In the embodiment illustrated in FIG. 1, the container 10 is shaped to be used as an egg box. For simplicity purposes, the container 10 will hereinafter be referred to as "egg box." There are eighteen receiving cavities 14 in the egg box, each provided to accommodate one egg. The base portion 12 may have more or fewer receiving cavities 14, but are commonly in multiples of six (e.g., 6, 12, 18). The construction of the receiving cavities 14 will be described in further detail hereinafter. The cover portion 11 defines an inner cavity that will accommodate the top portion of the eggs.

The tray 10 is preferably stackable. Therefore, spacers 16 are provided between adjacent receiving cavities 14. The spacers 16 ensure that the trays 10 in the opened position of FIG. 1 may be readily separated from one another when nested into each other.

In order to releasably lock the cover portion 11 to the base portion 12 when eggs are accommodated in the receiving cavities 14, fasteners are provided throughout the periphery of the tray 10. Firstly, complementary fasteners 18A and 18B are respectively provided on the cover portion 11 and the base portion 12. The complementary fasteners 18A and 18B, respectively, are in the illustrated embodiment male/female protrusions/cavities of circular cross section. The protrusions and cavities are sized to provide some level of interference when mated, thereby requiring some manual force to separate the cover portion 11 from the base portion 12. In an embodiment, the fasteners 18A and 18B each have an oval shape, but with the elongated axes of complementary fasteners being transverse.

Additionally, complementary guides 20A and 20B are respectively provided on the cover portion 11 and the base portion 12. The complementary guides 20A and 20B are centrally positioned within the cover portion 11 and the base portion 12, and add structural rigidity to the egg box while ensuring that the fasteners 18A and 18B are aligned to facilitate the closure of the container 10. More specifically, the guide 20A is in the form of an arch that will sit on the guide 20B, without any interference between the guides 20A and 20B by way of a slight positive angle (e.g., 3 degrees from vertical). The relatively large contact surface between the guides 20A and 20B will spread the weight from items resting on the cover portion 11 when the egg box is closed. For instance, in refrigerated enclosures, full egg boxes are stacked one on another, whereby the guides 20A and 20B help reduce the risk of collapse of an undermost egg box by the weight of other egg boxes (enclosing eggs).

A pull tab 22 is provided on the cover portion 11. The pull tab 22 is manually pulled to open a closed egg box (FIG. 3). The pull tab 22 is typically a raised portion that will define a small gap between the cover portion 11 and the base portion 12, so as to be readily grasped.

Similarly, vents 24 are optionally provided on the periphery of the egg box in combination with chimneys 25 to allow circulation of air into and out of the egg box. The vents 24 typically are raised portions in the cover portion 11 or the base portion 12. It is considered to adjust the dimensions of the chimneys 25 to control the volume of air circulating in and out of the container 10.

Referring to FIG. 2, a clearance surface 26 is provided on a connector peripheral surface of the cover portion 11. The connector peripheral surface of the cover portion 11 cooperates with a connector peripheral surface 27 of the base portion 12 to provide some additional interference between the cover portion 11 and the base portion 12 when closed. The clearance surface 26 is provided so as not to have the connector peripheral surface of the cover portion 11 impede with the pivoting motion of the cover portion 11 toward engagement with the base portion 12. An offset width of 80 mil is suitable for the clearance surface 26, but other dimensions are considered as a function of the dimensions of the container 10. The clearance surface 26 facilitates the closure and engagement of the cover portion 11 with the base portion 12.

It is also pointed out that the inner cavity of the cover portion is defined by a generally flat wall. In prior art containers, some horizontal shoulders were present in the flat wall of the cover portion, which affected the structural integrity of the cover portion, especially in the corners of the between portions of the flat walls.

Figure 4:
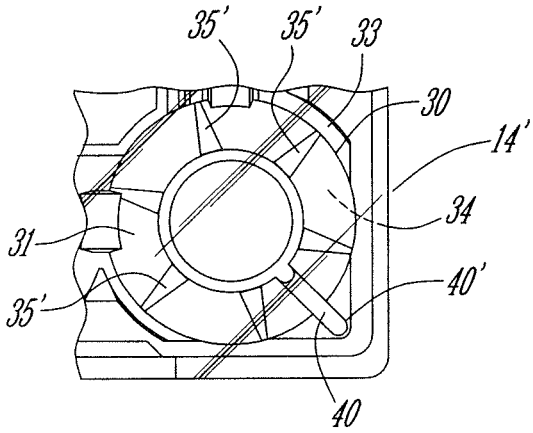
FIG. 4 is an enlarged plan view of a receiving cavity positioned at a leading corner of the container of FIG. 1.

Referring concurrently to FIGS. 2 to 4, the receiving cavities 14 are shown in greater detail. Each receiving cavity 14 has an upper cylindrical portion 30, a frustoconical portion 31 and a bottom cylindrical portion 32. The frustoconical portion 31 defines a taper between the upper cylindrical portion 30 and the bottom cylindrical portion 32. A corner edge 33 protrudes radially outwardly from the upper cylindrical portion 30 and serves to strengthen each cavity 14 at the upper cylindrical portion 30.

Figure 5:
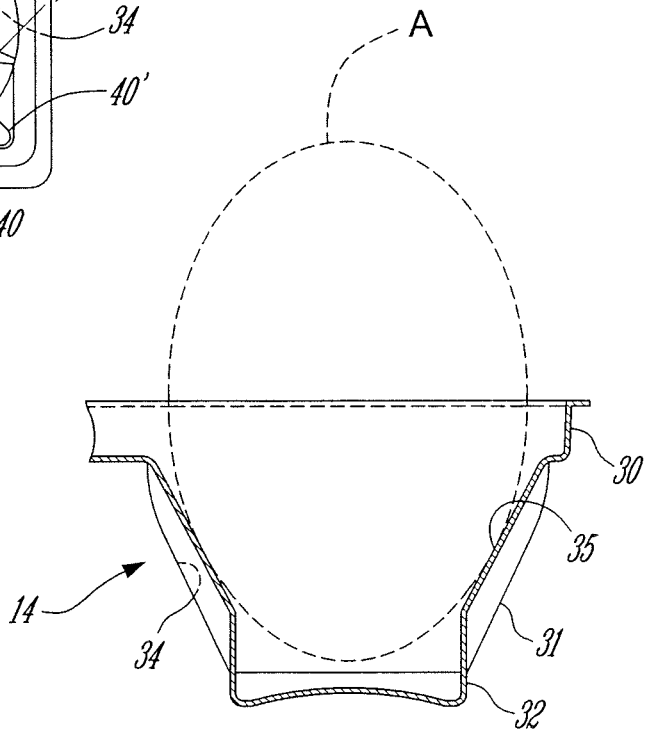
FIG. 5 is a sectional view taken along section lines 5-5 of a receiving cavity of the container of FIG. 1, with an egg in the receiving cavity.

Referring to FIG. 5, an interior of the cavities 14 is defined by a main surface 34 opposite the egg A. In order to protect the frangible article (i.e., the egg A), the contact area between the cavity 14 and the frangible article is reduced by having lugs 35 projecting inwardly in the cavity 14. The lugs 35 separate the egg A from the main surface 34, by forming air gaps between the main surface 34 and the egg A. The lugs 35 are in the frustoconical portion 31, and flare toward the bottom cylindrical portion 32. Accordingly, the egg A is suspended in the frustoconical portion 31 as it does not contact the main surface 34 in the bottom cylindrical portion 32.

In order to protect cavities 14' positioned at the corners of a leading edge of the container 10, a protective rib 40 is provided in each corner cavity 14'. Referring concurrently to FIGS. 1, 3 and 4, the protective rib 40 is oriented toward its associated corner of the container 10 and projects outwardly from the main surface 34, so as to protrude from an outer surface of the corner cavity 14'.

In an embodiment, the protective rib 40 has a semicircular cross section, so as to have the geometry of a half-cylinder. The protective rib 40 extends from an lower edge of the bottom cylindrical portion 32 and extends upwardly to the corner edge 33. The end 40' of the protective rib 40 merging with the corner edge 33 has trapezoid-shaped sides, because of its connection to the upper cylindrical portion 30.

It is, however, pointed out that the longitudinal axis of the half-cylinder of the protective rib 40 is a straight line from the bottom cylindrical portion 32 to the upper cylindrical portion 30. Therefore, in addition to exposing a semicircular structure against impacts, the protective rib 40 provides structural integrity in the vertical direction by relating the bottom cylindrical portion 32 to the corner edge 34. Moreover, impacts on the protective rib 40 will be spread to the bottom cylindrical portion 32 and the corner edge 34, and/or will be absorbed by the protective rib 40 deforming.

In order to provide suitable structural integrity to the corner cavity 14', a suitable diameter for the section of the protective rib 40 is of 2.0 mm, although it is considered to provide diameters starting at 1.5 mm, with a radius of projection of at least 0.75 mm.

Although the protective ribs 40 are illustrated as being provided on a single edge of the container 10 (i.e., the leading edge), it is considered to provide protective ribs 40 on all four corners of the container 10. The corners 14' are defined as being the leading corners of the container 10. It is pointed out that leading corner refers to a direction in which the container 10 is fed on the automated production line. Accordingly, the leading corner may also be the corner adjacent to the hinge portion 13. As the protective ribs 40 are aligned with the corners of the container 10, the structural integrity of the container 10 is enhanced when comes time to press the cover portion 11 into mating engagement with the base portion 12 at the corners of the container. The process of engaging the cover portion 11 to the base portion 12 is commonly done in an automated process, and the lack of rigidity at the corners of the container 10 has resulted in a temporary deformation leading to a failure of the cover portion 11 to engage the base portion 12. The additional rigidity provided by the ribs 40 facilitates the engagement of the cover portion 11 to the base portion 12 in the automated process.

Figure 6:
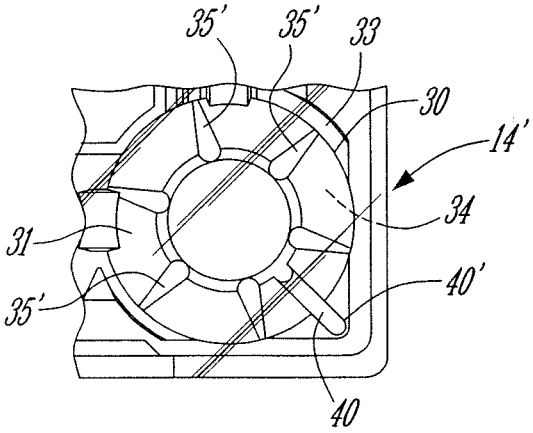
FIG. 6 is an enlarged plan view of a receiving cavity positioned at a leading corner of a container in accordance with another embodiment of the present invention.

Referring to FIG. 6, the cavity 14' is shown in accordance with another embodiment. In the cavity 14' of FIG. 6, lugs 35' extend all the way to the bottom cylindrical portion 32 to define an arcuate outline. Therefore, a diameter formed by the lugs 35' is smaller than a diameter formed by the lugs 35 (FIG. 4). The lugs 35' are used for eggs of greater dimensions (e.g., jumbo eggs), to avoid contact between the egg and the bottom surface of the bottom cylindrical portion 32. Although the lugs 35' are illustrated as being part of the cavity 14' in FIG. 6, it is considered to provide the lugs 35' in any of the cavities 14.

Referring to FIG. 2, complementary fasteners 50 and 50' are respectively provided on the base portion 12 and the cover portion 11. The fasteners 50 and 50' mate to provide additional interference between the cover portion 11 and the base portion 12 when in the closed position. The fasteners 50 and 50' are adjacent to the corners of the connector peripheries, but do not weaken the corners as they are not directly on the corners.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the equivalents accorded to the appended claims.

The invention claimed is:

1. A container comprising a tray, the tray comprising:

an upper wall member defining a longitudinal axis and having a longitudinal edge parallel to the longitudinal axis and an end edge transverse to the longitudinal edge, the longitudinal edge and the end edge defining a corner of the tray;

a plurality of item-receiving cavities, each cavity having a bottom, an upper end, a frustoconical wall portion between the bottom and the upper end, and a cylindrical wall portion proximate the upper end, the plurality of cavities including a corner cavity disposed proximate the corner of the tray; and the corner cavity having a protective rib projecting outwardly at an angle relative to the longitudinal axis toward the corner, the protective rib extending from the bottom to the upper end and having a trapezoidal shape disposed on the cylindrical wall portion.

2. The container of claim 1, wherein the protective rib has a uniform depth and a uniform cross-sectional radius along at least the frustoconical wall portion.

3. The container of claim 1, wherein each cavity has a plurality of inwardly projecting lugs to support an article within the cavity.

4. The container of claim 3, wherein the plurality of lugs are disposed proximate the frustoconical wall portion, each lug having a width increasing toward the cylindrical wall portion.

5. The container of claim 3, wherein the protective rib is disposed between a pair of the plurality of lugs.

6. The container of claim 1, wherein each cavity has a further cylindrical wall portion extending upwardly from the bottom.

7. The container of claim 1, the tray further comprising a fastener to receive a cover, the fastener disposed proximate the protective rib.

8. The container of claim 1, further comprising a cover and a hinge extending from a side of the upper wall member, the hinge joining the tray and the cover, the corner cavity disposed proximate the corner of the upper wall opposite the hinge.

9. The container of claim 8, further comprising an opposing corner cavity disposed proximate an opposing corner of the upper wall opposite the hinge, the opposing corner cavity having a further protective rib.

10. The container of claim 1, wherein the tray is formed of a sheet of polymeric material.

11. A container comprising a tray, the tray comprising:

an upper wall member defining a longitudinal axis and having a longitudinal edge parallel to the longitudinal axis and an end edge transverse to the longitudinal edge, the longitudinal edge and the end edge defining a corner of the tray;

a plurality of item-receiving cavities, each cavity having a bottom, an upper end, and a frustoconical wall portion therebetween, the plurality of cavities including a corner cavity disposed proximate the corner of the tray; and the corner cavity having a protective rib projecting outwardly at an angle relative to the longitudinal axis toward the corner, the protective an outer edge of the bottom to a corner edge of the upper end and having a uniform depth and a uniform cross-sectional radius along at least the frustoconical wall portion.

12. The container of claim 11, wherein each cavity has a cylindrical wall portion proximate the upper end.

13. The container of claim 11, wherein each cavity has a plurality of inwardly projecting lugs to support an article within the cavity.

14. The container of claim 13, wherein the plurality of lugs are disposed proximate the frustoconical wall portion, each lug having a width increasing toward the cylindrical wall portion.

15. The container of claim 13, wherein the protective rib is disposed between a pair of the plurality of lugs.

16. The container of claim 11, wherein each cavity has a cylindrical wall portion extending upwardly from the bottom.

17. The container of claim 11, the tray further comprising a fastener to receive a cover, the fastener disposed proximate the protective rib.

18. The container of claim 11, further comprising a cover and a hinge extending from a side of the upper wall member, the hinge joining the tray and the cover, the corner cavity disposed proximate the corner of the upper wall opposite the hinge.

19. The container of claim 18, further comprising an opposing corner cavity disposed proximate an opposing corner of the upper wall opposite the hinge, the opposing corner cavity having a further protective rib.

20. The container of claim 11, wherein the tray is formed of a sheet of polymeric material.

* * * * *